United States Patent [19]

Momoi

[11] Patent Number: 4,947,727

[45] Date of Patent: Aug. 14, 1990

[54] FISHING NET TWINE AND A FISHING NET MADE THEREOF

[75] Inventor: Atsushi Momoi, Akoo, Japan

[73] Assignee: Momoi Fishing Net Mfg. Co., Ltd., Hyogo, Japan

[21] Appl. No.: 774,097

[22] Filed: Sep. 9, 1985

[51] Int. Cl.[5] ..... A01K 73/00; D02G 3/22; D02G 3/36; D02G 3/44

[52] U.S. Cl. ..... 87/12; 57/210; 57/211; 57/231; 57/236; 57/238; 57/243

[58] Field of Search ..... 87/12, 1; 43/7, 10, 43/14; 57/210, 211, 212, 218, 224, 200, 231, 236, 237, 243, 238, 244

[56] References Cited

U.S. PATENT DOCUMENTS

| | | | |
|---|---|---|---|
| 2,999,413 | 9/1961 | Momoi | 87/12 |
| 3,329,061 | 7/1967 | Momoi | 87/12 |
| 3,369,317 | 2/1968 | Brownell | 87/12 |
| 3,507,109 | 4/1970 | Nakazawa | 87/12 X |
| 3,805,508 | 4/1974 | Maderna | 57/212 |
| 4,272,950 | 6/1981 | Bompard | 57/210 X |
| 4,299,884 | 11/1981 | Payen | 57/210 X |
| 4,313,998 | 2/1982 | Pivot et al. | 57/210 X |
| 4,466,331 | 8/1984 | Matheson | 87/12 |

*Primary Examiner*—John Petrakes

*Attorney, Agent, or Firm*—Frishauf, Holtz, Goodman & Woodward

[57] ABSTRACT

A fishing net twine comprising a single first yarn and a plurality of second yarns which are orderly stranded together with the first yarn. The first yarn is a bundle of multiple filaments having a thickness of 8 to 42 denier and a monofilament having a thickness of 0.10 to 0.24 mm which are stranded together. The second yarn includes a number of monofilaments having a thickness of 0.10 to 0.24 mm.

58 Claims, 3 Drawing Sheets

FISHING NET TWINE AND A FISHING NET MADE THEREOF

BACKGROUND OF THE INVENTION (a) Field of the Invention

This invention relates to twine for a fishing net, particularly, a gill net and to a fishing net made of the twine.

(b) Description of the Prior Art

For forming a gill net, it was customary to use monofilament or twine prepared by entwining multiple filaments. However, the twine is low in transparency and invisibility, with the result that the gill net can be readily sensed by fish in water. Naturally, the fishing is adversely affected. The monofilament is certainly high in transparency. But, the filament itself is very rigid and is bulky when thickened, with the result that it is troublesome to handle the gill net on a fishing boat.

SUMMARY OF THE INVENTION

An object of the present invention is to provide twine which is high in transparency or invisibility and flexibility, and a fishing net made of the twine. The twine of the present invention permits the above-noted defect inherent in the conventional twine for a fishing net to be overcome.

According to the present invention, there is provided a fishing net twine comprising a single first yarn prepared by stranding a bundle of multiple filaments together with a monofilament; and a second yarn comprising a plurality of monofilaments which are stranded together with the single first yarn. Also provided is a fishing net made of the particular twine. As is used in the present specification and claims, the term "stranded" is used in accordance with its dictionary definition to generically refer to, for example, twisting or spirally winding to form a unit.

In the fishing net twine of the present invention, the first yarn, which consists of a bundle of multiple filaments and a monofilament, may be prepared by winding the bundled multiple filaments about the monofilament or by mutually entwining (i.e., twisting together) the bundled multifilaments and the monofilament. The entwining or twisting direction and pitch are not particularly restricted in the present invention.

The multiple filaments included in the first yarn consist of 5 to 24 filaments each having a thickness of, generally, 8 to 42 denier and being formed of a synthetic resin such as nylon, polyethylene, polypropylene, copolymer of vinylchloride and vinyl acetate and polyacrylonitrile. On the other hand, the monofilament included in the first yarn should be formed of a similar synthetic resin and should desirably have a thickness of, generally, 0.01 to 0.24 mm.

The second yarn is formed of a synthetic resin similar to that used for forming the multiple filaments. In general, it is desirable to use 6 to 38 monofilaments each having a thickness of 0.01 to 0.24 mm for forming the second yarn. It is also desirable for the sum of the filaments constituting the first yarn and the filaments constituting the second yarn to be 30 or more. The monofilaments constituting the second yarn may be orderly wound spirally about the first yarn acting as a core. Alternatively, the first and second yarns may be entwined or twisted together without using the first yarn as a core.

In short, the fishing net twine of the present invention comprises a first yarn prepared by winding multiple filaments about a single monofilament, or by simply entwining (i.e., twisting) the multiple filaments and the single filament together. Further, a plurality of monofilaments providing a second yarn are orderly wound spirally about the first yarn acting as a core so as to provide a desired twine. Alternatively, the first and second yarns are orderly entwined (i.e., twisted) together so as to provide a desired fishing net twine. The particular construction outlined above permits providing twine having an excellent transparency. It follows that the fishing net formed of the particular twine is unlikely to be sensed by fish when put in water, leading to a high fishing rate. In addition, the twine of the present invention is highly flexible, with the result that the fishing net is not rendered bulky on a fishing boat and, thus, can be easily handled.

Also, where the second yarn is spirally wound about the first yarn acting as a core, the monofilaments forming the second yarn are orderly arranged and made stable, with the result that, in the step of forming a fishing net, the knots of the fishing net can be formed easily and can be made stronger. Where a plurality of monofilaments are wound about the core yarn consisting of only multiple filaments, the filaments of the core yarn are exposed to the outside when a fishing net formed of the resultant twine is put in water. As a result, the twine is made fluffy by abrasion, leading to a reduction in transparency and rust deposition to the twine. However, where multiple filaments and monofilaments are used in combination as in the present invention, particularly, where the first yarn is used as the core, it is possible to prominently suppress the above-noted defects inherent in the prior art.

DETAILED DESCRIPTION OF THE PREFERRED EMBODIMENTS

Figure 2:
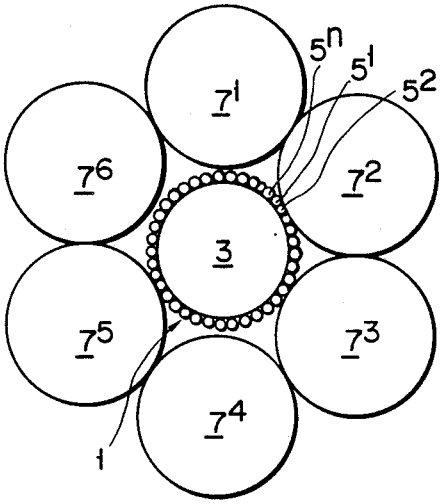
FIG. 2 is a cross sectional view showing the twine for a fishing net according to one embodiment of the present invention.
Figure 4:
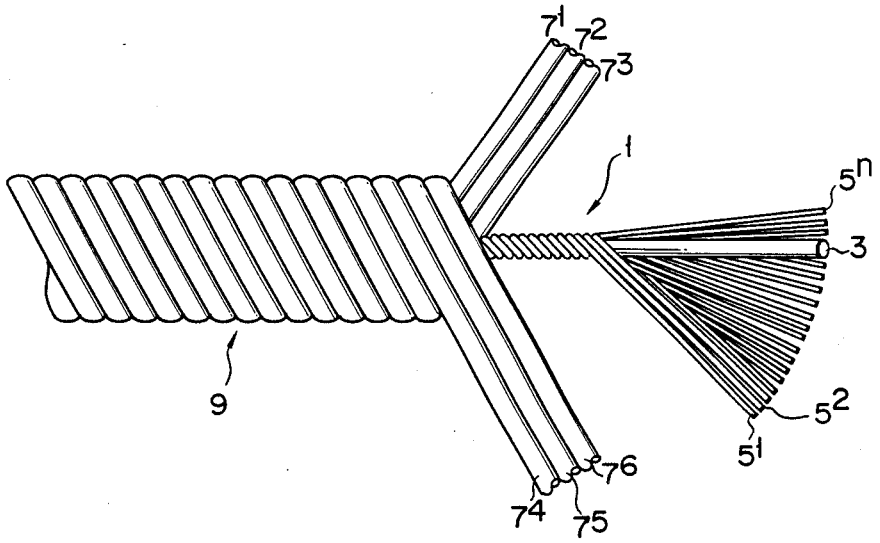
FIG. 4 is a side view, partly broken away, showing the twine for a fishing net shown in FIG. 2.

In the embodiment of FIGS. 2 and 4, a core yarn 1 consists of a nylon monofilament 3 having a diameter of 0.2 mm and n-number of nylon multiple filaments $\mathbf{5^1}$–$\mathbf{5^n}$ spirally wound about the monofilament 3. The multiple filaments have a thickness of, for example, 210 denier/24 filaments or 210 denier/14 filaments. As shown in FIG. 4, six nylon monofilaments $\mathbf{7^1}$ to $\mathbf{7^6}$ each having a diameter of 0.2 mm, which are arranged in parallel, are orderly wound, spirally about the core yarn 1 in the same direction as the winding direction of the multiple filaments $\mathbf{5^1}$ to $\mathbf{5^n}$ so as to form a fishing net twine 9.

Where the core yarn 1 comprises 14 multiple filaments, it is necessary to wind at least 15 monofilaments about the core yarn 1.

Figure 1:
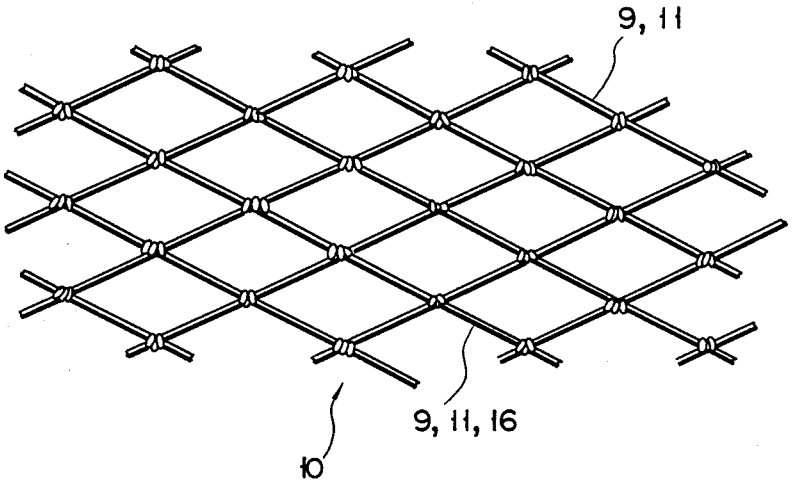
FIG. 1 is a plan view showing a gill net formed of the twine for a fishing net of the present invention.

The resultant twine 9 is braided by the conventional method so as to form a knotted net 10 as shown in FIG. 1. The knotted net 10 thus formed has been found to be very flexible and excellent in transparency or invisibility in water. It has been confirmed that the net 10, when used in water, is substantially free from the fluffing problem.

In the embodiment shown in FIGS. 2 and 4, the monofilaments $7^1$ to $7^6$ are wound in the same direction as the winding direction of the multiple filaments $5^1$ to $5^n$. However, the monofilaments $7^1$ to $7^6$ may be wound in the direction opposite to the winding direction of the multiple filaments $5^1$ to $5^n$, with substantially the same effects.

Figure 3:
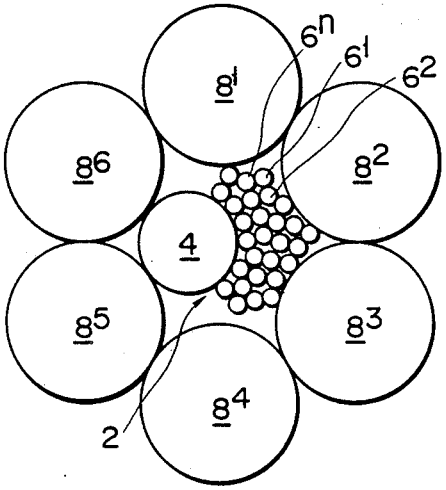
FIG. 3 is a cross sectional view showing the twine for a fishing net according to another embodiment of the present invention.
Figure 5:
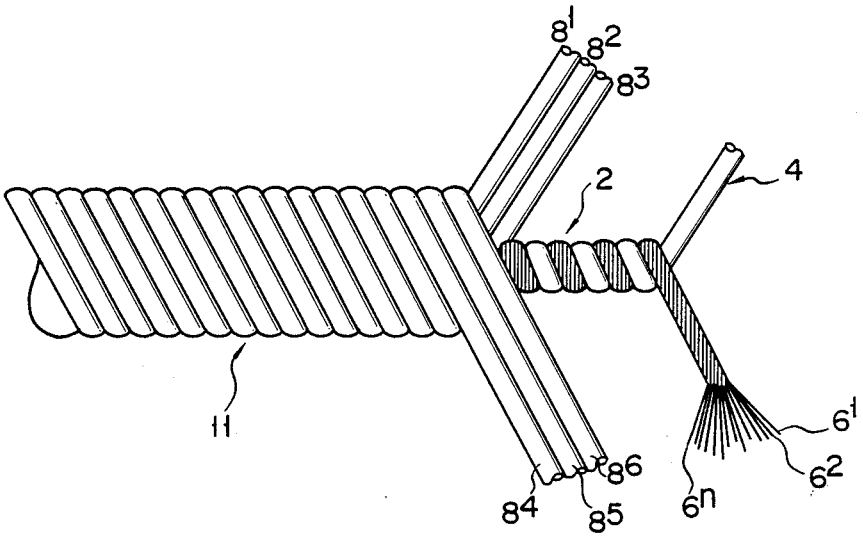
FIG. 5 is a side view, partly broken away, showing the twine for a fishing net shown in FIG. 3.

FIGS. 3 and 5 collectively show another embodiment of the present invention. In this embodiment, a core yarn 2 is prepared by mutually entwining (i.e., twisting) a nylon monofilament 4 having a diameter of 0.2 mm together with n-number of nylon multiple filaments $6^1$ to $6^n$ each having a thickness of, for example, 210 denier/24 filaments or 210 denier/14 filaments. Further, six nylon monofilaments $8^1$ to $8^6$ each having a diameter of 0.2 mm, which are arranged in parallel, are spirally wound about the core yarn 2 in the same direction as the entwining (i.e., twisting) direction of the core yarn 2 so as to form a fishing net twine 11, as shown in FIG. 5. Where core yarn 2 includes 14 multiple filaments, it is necessary to spirally wind at least 15 monofilaments about the core yarn 2.

The resultant twine 11 is braided as in the prior art so as to form a knotted net 10 as shown in FIG. 1. The net 10 thus formed has been found excellent in flexibility and transparency or invisibility. It has also been confirmed that the net 10, when put in water, is substantially free from the fluffing problem. The monofilaments $8^1$ to $8^6$ may also be spirally wound in the direction opposite to the entwining or twisting direction of the core yarn 2, with substantially the same effects.

Figure 6:
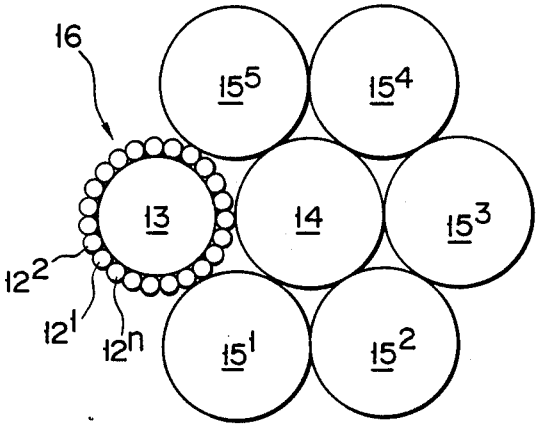
FIG. 6 is a cross sectional view showing the twine for a fishing net according to still another embodiment of the present invention.
Figure 7:
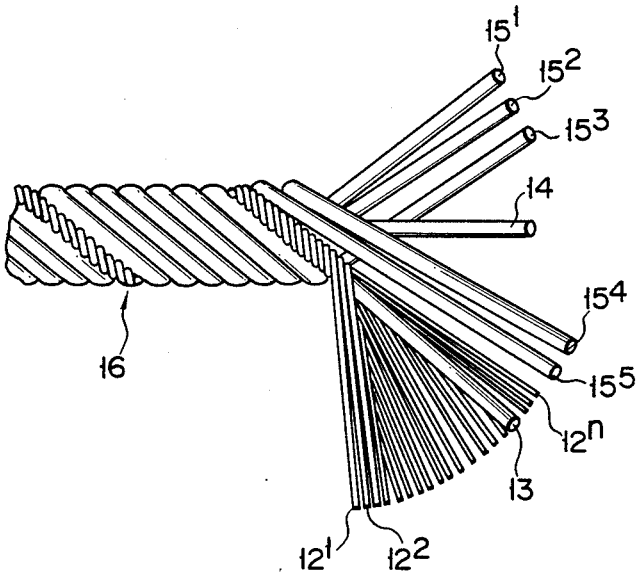
FIG. 7 is a side view, partly broken away, showing the twine for a fishing net shown in FIG. 6.

FIGS. 6 and 7 collectively show still another embodiment of the present invention. In this embodiment, first and second yarns are orderly wound spirally about a core consisting of a monofilament. To be more specific, the first yarn is prepared by spirally winding n-number of nylon multiple filaments $12^1$ to $12^n$ each having a thickness of 210 denier/24 filaments or 210 denier/14 filaments about a nylon monofilament 13. The first yarn thus prepared has a diameter of about 0.2 mm. Further, a second yarn consisting of nylon monofilaments $15^1$ to $15^5$ each having a diameter of 0.2 mm are orderly wound spirally together with the first yarn about a core yarn 14 consisting of a nylon monofilament so as to form a fishing net twine 16.

The resultant twine 16 is braided as in the prior art so as to form a knotted net 10 as shown in FIG. 1. The net 10 thus prepared has been found excellent in flexibility and transparency or invisibility as in the embodiments described previously.

In the embodiments described above, the monofilaments and multiple filaments forming the fishing net twine are made of nylon. However, filaments of other synthetic resins such as polyethylene, polypropylene, vinyl chloride/vinyl acetate copolymer and polyacrylonitrile may also be used in the present invention, with satisfactory results.

What is claimed is:

1. A fishing net twine, comprising:

a single first yarn comprising a plurality of multiple filaments and a monofilament which are stranded together, said monofilament being thicker than each of said multiple filaments; and a second yarn comprising a plurality of monofilaments which are stranded together with said single first yarn, said monofilaments of said second yarn being thicker than each of said multiple filaments of said single first yarn.

2. The fishing net twine of claim 1, wherein said single first yarn comprises a single monofilament stranded with said multiple filaments.

3. The fishing net twine of claim 2, wherein said monofilaments of said second yarn are stranded together with first yarn in a twisting or winding direction which is the same as the twisting or winding direction of said multiple filaments of said single first yarn.

4. The fishing net twine of claim 2, wherein said plurality of multiple filaments consists of 5 to 24 filaments.

5. The fishing net twine of claim 1, wherein the first yarn comprises a monofilament and a bundle of said multiple filaments, said monofilament and bundle of multiple filaments being stranded together.

6. The fishing net twine of claim 5 wherein said second yarn is stranded together with said single first yarn in a twisting or winding direction which is the same as the twisting or winding direction of said single first yarn.

7. The fishing net twine of claim 1, wherein the sum of the filaments constituting said single first yarn and the filaments constituting said second yarn is at least 30.

8. The fishing net twine of claim 1, wherein each of said multiple filaments of said single first yarn has a thickness of from 8 to 42 denier.

9. The fishing net twine of claim 1, wherein each of said monofilaments of said second yarn has a thickness of from 0.10 to 0.24 mm.

10. The fishing net twine of claim 1, wherein said second yarn consists of 6 to 38 of said monofilaments.

11. A fishing net comprising the fishing net twine defined in claim 1.

12. A fishing net twine, comprising:

a single first yarn comprising a plurality of multiple filaments spirally wound about a monofilament, said monofilament being thicker than each of said multiple filaments; and a second yarn comprising a plurality of monofilaments which are orderly wound spirally about said single first yarn, said monofilaments of said second yarn being thicker than each of said multiple filaments of said single first yarn.

13. The fishing net twine of claim 12, wherein said monofilaments of said second yarn are spirally wound about said single first yarn in the same direction as the winding direction of said multiple filaments about said monofilament of said single first yarn.

14. The fishing net twine of claim 12, wherein said single first yarn comprises a single monofilament, said multiple filaments being spirally wound about said single monofilament.

15. The fishing net twine of claim 14, wherein said monofilaments of said second yarn are spirally wound about said single first yarn in the same direction as the winding direction of said multiple filaments about said monofilament of said single first yarn.

16. The fishing net twine of claim 12, wherein the sum of the filaments constituting said single first yarn and the filaments constituting said second yarn is at least 30.

17. The fishing net twine of claim 12, wherein said plurality of multiple filaments consists of 5 to 24 filaments.

18. The fishing net twine of claim 12, wherein each of said multiple filaments of said single first yarn has a thickness of from 8 to 42 denier.

19. The fishing net twine of claim 18, wherein said monofilament of said single first yarn has a thickness of 0.01 to 0.24 mm.

20. The fishing net twine of claim 19, wherein each of said monofilaments of said second yarn has a thickness of from 0.10 to 0.24 mm.

21. The fishing net twine of claim 18, wherein each of said monofilaments of said second yarn has a thickness of from 0.10 to 0.24 mm.

22. The fishing net twine of claim 12, wherein said monofilament of said single first yarn has a thickness of 0.01 to 0.24 mm.

23. The fishing net twine of claim 22, wherein each of said monofilaments of said second yarn has a thickness of from 0.10 to 0.24 mm.

24. The fishing net twine of claim 12, wherein each of said monofilaments of said second yarn has a thickness of from 0.10 to 0.24 mm.

25. The fishing net twine of claim 12, wherein said second yarn consists of 6 to 38 of said monofilaments.

26. The fishing net twine of claim 12, wherein said multiple filaments and said monofilaments are made of a material selected from the group consisting of nylon, polyethylene, polypropylene, vinyl chloride/vinyl acetate copolymer and polyacrylonitrile.

27. A fishing net twine, comprising:

a single first yarn comprising a plurality of multiple filaments and a monofilament which are entwined or twisted together, said monofilament being thicker than each of said multiple filaments; and a second yarn comprising a plurality of monofilaments which are orderly wound spirally about said single first yarn, said monofilaments of said second yarn being thicker than each of said multiple filaments of said single first yarn.

28. The fishing net twine of claim 27, wherein said monofilaments of said second yarn are spirally wound about said single first yarn in the same direction as the twisting direction of said multiple filaments and monofilament of said single first yarn.

29. The fishing net twine of claim 27, wherein said single first yarn comprises a single monofilament entwined or twisted together with said multiple filaments.

30. The fishing net twine of claim 29, wherein said monofilaments of said second yarn are spirally wound about said single first yarn in the same direction as the twisting direction of said multiple filaments and monofilament of said single first yarn.

31. The fishing net twine of claim 27, wherein the sum of the filaments constituting said single first yarn and the filaments constituting said second yarn is at least 30.

32. The fishing net twine of claim 27, wherein said plurality of multiple filaments consists of 5 to 24 filaments.

33. The fishing net twine of claim 27, wherein each of said multiple filaments of said single first yarn has a thickness of from 8 to 42 denier.

34. The fishing net twine of claim 33, wherein said monofilament of said single first yarn has a thickness of 0.01 to 0.24 mm.

35. The fishing net twine of claim 34, wherein each of said monofilaments of said second yarn has a thickness of from 0.10 to 0.24 mm.

36. The fishing net twine of claim 33, wherein each of said monofilaments of said second yarn has a thickness of from 0.10 to 0.24 mm.

37. The fishing net twine of claim 27, wherein said monofilament of said single first yarn has a thickness of 0.01 to 0.24 mm.

38. The fishing net twine of claim 37, wherein each of said monofilaments of said second yarn has a thickness of from 0.10 to 0.24 mm.

39. The fishing net twine of claim 27, wherein each of said monofilaments of said second yarn has a thickness of from 0.10 to 0.24 mm.

40. The fishing net twine of claim 27, wherein said second yarn consists of 6 to 38 of said monofilaments.

41. The fishing net twine of claim 27, wherein said multiple filaments and said monofilaments are made of a material selected from the group consisting of nylon, polyethelene, polypropylene, vinyl chloride/vinyl acetate copolymer and polyacrylonitrile.

42. The fishing net twine of claim 27, wherein said multiple filaments of said single first yarn are spirally entwined or twisted together, said spirally entwined or twisted together multiple filaments being spirally entwined or twisted together with said monofilament of said single first yarn.

43. A fishing net twine, comprising:

a single first yarn comprising a plurality of multiple filaments spirally wound about a monofilament, said monofilament being thicker than each of said multiple filaments; and a second yarn comprising a plurality of monofilaments which are entwined or twisted together with said single first yarn, said monofilaments of said second yarn being thicker than each of said multiple filaments of said single first yarn.

44. The fishing net twine of claim 43, wherein said monofilaments of said second yarn are entwined or twisted together with said single first yarn in the same direction as the winding direction of said multiple filaments about said monofilament of said single first yarn.

45. The fishing net twine of claim 43, wherein said single first yarn comprises a single monofilament, said multiple filaments being spirally wound about said single monofilament.

46. The fishing net twine of claim 45, wherein said monofilaments of said second yarn are entwined or twisted together with said single first yarn in the same direction as the winding direction of said multiple filaments about said monofilament of said single first yarn.

47. The fishing net twine of claim 43, wherein the sum of the filaments constituting said single first yarn and the filaments constituting said second yarn is at least 30.

48. The fishing net twine of claim 43, wherein said plurality of multiple filaments consists of 5 to 24 filaments.

49. The fishing net twine of claim 43, wherein each of said multiple filaments of said single first yarn has a thickness of from 8 to 42 denier.

50. The fishing net twine of claim 49, wherein said monofilament of said single first yarn has a thickness of 0.01 to 0.24 mm.

51. The fishing net twine of claim 50, wherein each of said monofilaments of said second yarn has a thickness of from 0.10 to 0.24 mm.

52. The fishing net twine of claim 49, wherein each of said monofilaments of said second yarn has a thickness of from 0.10 to 0.24 mm.

53. The fishing net twine of claim 43, wherein said monofilament of said single first yarn has a thickness of 0.01 to 0.24 mm.

54. The fishing net twine of claim 53, wherein each of said monofilaments of said second yarn has a thickness of from 0.10 to 0.24 mm.

55. The fishing net twine of claim 43, wherein each of said monofilaments of said second yarn has a thickness of from 0.10 to 0.24 mm.

56. The fishing net twine of claim 43, wherein said second yarn consists of 6 to 38 of said monofilaments.

57. The fishing net twine of claim 43, wherein said multiple filaments and said monofilaments are made of a material selected from the group consisting of nylon, polyethelene, polypropylene, vinyl chloride/vinyl acetate copolymer and polyacrylonitrile.

58. The fishing net twine of claim 43, further comprising a further monofilament which is thicker than said multiple filaments, said entwined or twisted together first and second yarns being spirally wound about said further monofilament, said further monofilament serving as a core for said fishing net twine.

* * * * *